US005355841A

United States Patent [19]

Moore, Jr. et al.

[11] Patent Number: 5,355,841

[45] Date of Patent: Oct. 18, 1994

[54] WATER HEATER WITH INTEGRAL BURNER

[75] Inventors: H. Jack Moore, Jr., Playa Del Rey; Martin Abalos, Pomona, both of Calif.

[73] Assignee: Sabh (U.S.) Water Heater Group, Inc., Bala-Cynwyd, Pa.

[21] Appl. No.: 113,619

[22] Filed: Aug. 27, 1993

[51] Int. Cl.[5] ..... F22B 5/00

[52] U.S. Cl. ..... 122/17; 122/14; 126/361; 431/328

[58] Field of Search ..... 122/14, 17, 19; 126/361; 431/326, 328

[56] References Cited

U.S. PATENT DOCUMENTS 4,510,890 4/1985 Cowan ..... 122/17

4,672,919 6/1987 Staats ..... 122/17 X

*Primary Examiner*—Edward G. Favors

*Attorney, Agent, or Firm*—Miller & Christenbury

[57] ABSTRACT

A water heater having improved operating characteristics and lower costs of manufacturing is described. The water heater has an unified combustion chamber and burner construction.

22 Claims, 8 Drawing Sheets

WATER HEATER WITH INTEGRAL BURNER

The present invention relates to an improved construction for a gas water heater and particularly to a unified burner and combustion chamber construction and an improved flue.

BACKGROUND OF THE INVENTION

Water heaters are commonly employed in homes and small businesses to heat water for domestic use. Water heaters are produced in large numbers and sold to consumers in a very competitive market. A large portion of these devices use gaseous fuel, such as natural gas or bottled gas, as an energy source.

Conventional gas fired water heaters often include a tank adapted to contain a body of water, a water inlet, a water outlet, a combustion chamber disposed below or within the tank, a gas regulator and a burner disposed within the combustion chamber. The entire structure is thermally insulated. Conventionally, the gas regulator senses the temperature of water within the tank. When the water temperature drops below a certain minimum, gas is allowed to flow to the burner within the combustion chamber where it is ignited, heating the combustion chamber and the body of water above or around the combustion chamber. The products of combustion are vented through a flue connected to the combustion chamber and passing through the water containing tank. This general construction has been common for the last fifty years. Numerous variations upon this construction have been created in attempts to increase efficiency and otherwise improve operating characteristics.

Over the last several years, the efficiency of water heaters has become an important characteristic. This is the result of government regulation and also heightened consumer awareness concerning consumption of natural resources. Additionally, concern for the environment has made the elimination of potentially polluting substances from the products of combustion more important. While gas fired water heaters are very low polluters when compared to other fuel consuming products, there are many water heaters. Government bodies and consumers have therefore sought to further reduce the contribution of pollutants emanating from water heaters.

In addition to all of the above very important design criteria, cost is a very important factor in producing water heaters. Water heaters are purchased by builders and home owners in a very competitive environment. The products are mass produced and sold throughout a large marketplace. In the United States, national companies compete very aggressively for sales. Water heaters must therefore be very economically manufactured or they will not sell and consumers will not gain the benefits of design improvements.

In conventional water heaters, the above objects are not optimally achieved. Additionally, the cost of manufacturing remains high. A number of different components including a tank, a combustion chamber, a burner, a reflecting pan under the burner to protect the bottom of the water heater from burner heat and numerous other elements are manufactured and assembled. Often, changing a design to address one of the above identified problems compromises another of the problems or increases cost significantly.

OBJECTS OF THE INVENTION

An object of the invention is to provide a water heater of improved operating characteristics which is inexpensive to manufacture on a production basis.

It is another object of the present invention to provide a water heater which has reduced emissions of oxides of nitrogen.

It is still another object of the present invention to provide a water heater having both improved efficiency while the water heater is operating and improved efficiency overall, that is, low operating losses and low standby losses.

It is yet another object of the present invention to provide a water heater which consumes less materials in production and is less expensive to manufacture.

It is still another object of the present invention to provide a water heater having cooler external surfaces around the combustion chamber whereby special insulation techniques are not required.

It is still another object of the present invention to provide a water heater which economically extracts the maximum amount of heat from flue gasses.

It is still another object of the present invention to provide a water heater having a reduced number of individual parts.

Further objects and advantages to the invention will appear from the following detailed description of a preferred embodiment thereof and from the accompanying drawings.

SUMMARY OF THE INVENTION

The present invention contemplates a new and improved water heater construction which overcomes all of the above referred to problems and others and provides a water heater of simpler construction which is economical to manufacture, economical to operate, burns fuel cleanly and answers governmental regulations.

Briefly stated, in accordance with the principal aspect of the invention, a water heater is provided having a tank adapted to contain a body of water and an integrated combustion chamber and burner assembly below the tank.

Still further in accordance with the invention, a skirt generally matching the cross section of the tank is positioned below the tank and gas tightly fixed to the tank. A burner pan is positioned within this skirt and gas tightly fixed to the skirt around its entire periphery. A burner screen is positioned within the burner pan separating the volume within the skirt into a combustion chamber above the burner pan and a burner volume below the burner pan. A bottom pan is gas tightly sealed to the skirt around its bottom forming a gas tight burner chamber below the burner pan. A air and gas proportioner communicates through the skirt and into the burner chamber in a gas tight manner.

DETAILED DESCRIPTION OF THE INVENTION

Figure 1:
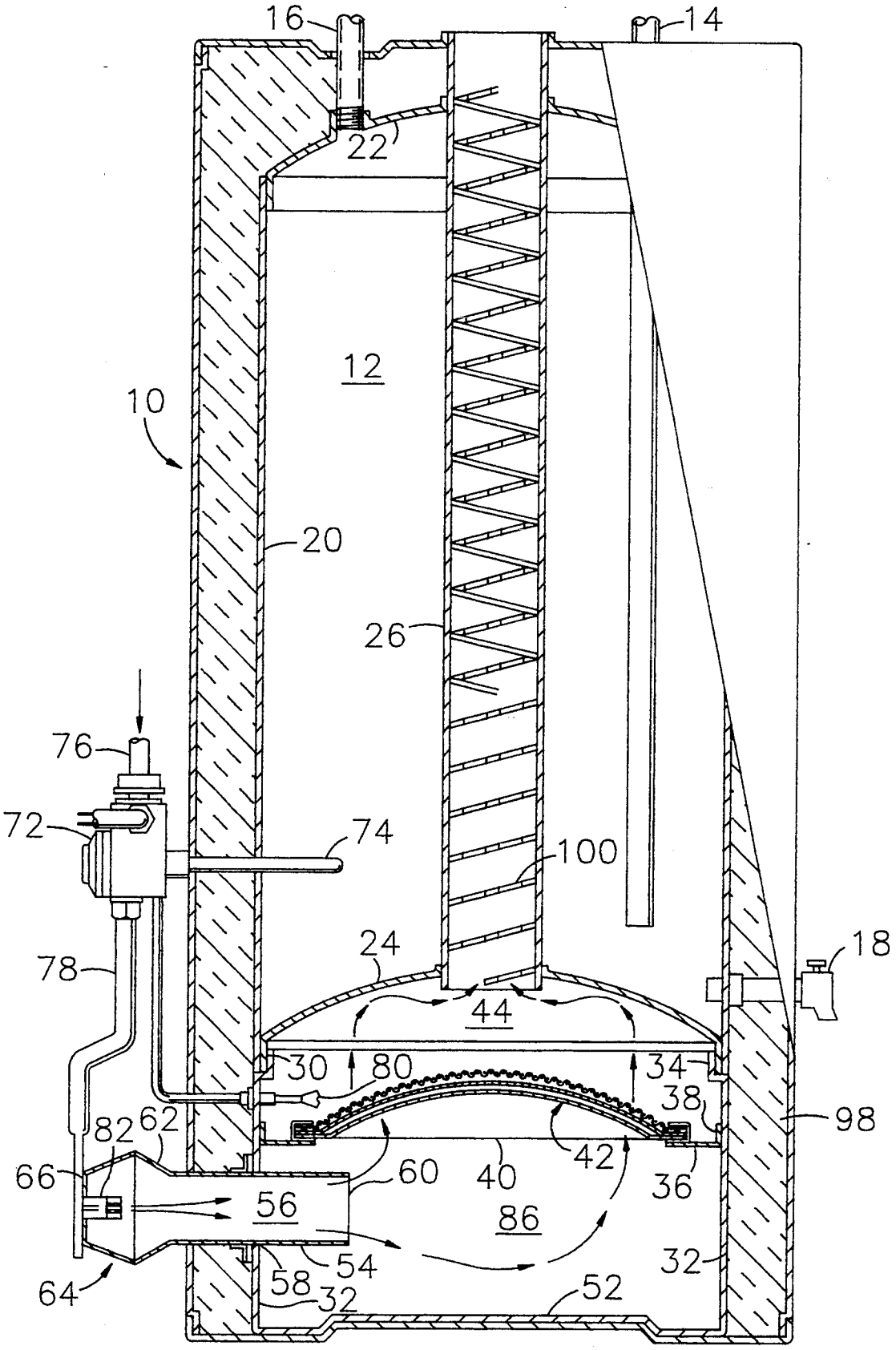
FIG. 1 is a side elevation of a water heater in accordance with the invention, mostly cut-away to the center line of the flue.
Figure 2:
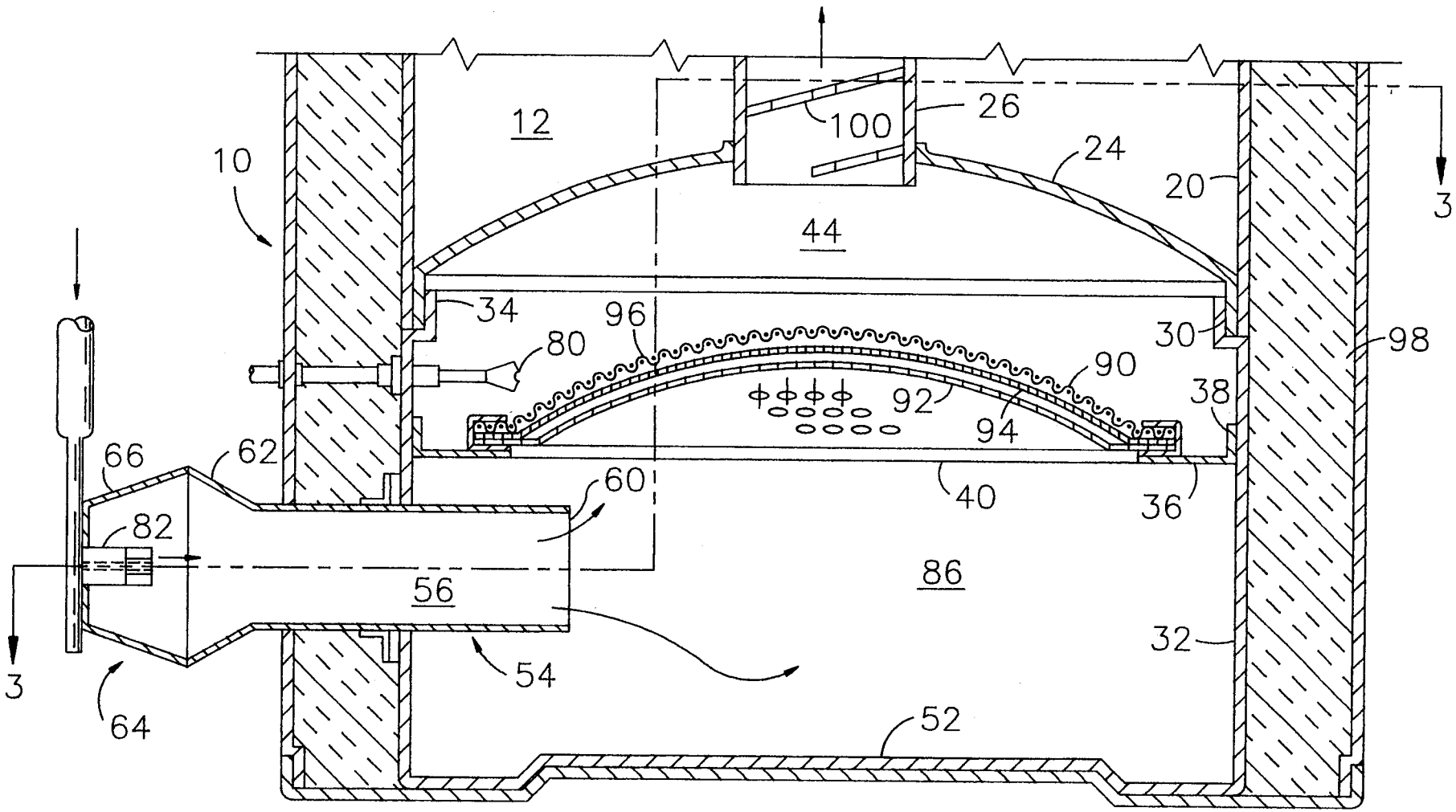
FIG. 2 is an enlarged detail drawing of the combustion chamber burner area of the water heater seen in FIG. 1.

Referring now to the drawings wherein the structures shown are for the purposes of illustrating the preferred embodiments of the invention and not for the purposes of limiting same, the figures in general and FIGS. 1 and 2 in particular, show a water heater 10 comprised of a tank 12 adapted to contain a body of water having an inlet 14 and an outlet 16. A drain 18 is also provided as is conventional. Tank 12 has a cylindrical side wall 20, a dome-shaped top 22, water tightly fixed to the side wall 20 and a bottom wall 24. A cylindrical flue 26 passes through the center of tank 12 and communicates with the space below bottom wall 24. Flue 26 having baffles 100 is conventionally connected to a conduit which will conduct products of combustion from the flue out of the building in which the water heat is located.

Bottom wall 24 is provided with a downwardly extending cylindrical flange 30 around its entire periphery. This flange 30 is permanently fixed to tank side wall 20 by means of welding or the like. A cylindrical skirt 32 is positioned below tank 12. Skirt 32 is provided with either a reduced portion 34 (shown) or an enlarged portion (not shown) which engages the bottom of tank 12. In the embodiment shown, reduced portion 34 is permanently fixed to the inside surface of flange 30 of bottom wall 24. Welding or the like provides a permanent gas tight joint between reduced portion 34 and flange 30.

A disc-shaped burner top pan 36 is provided with a flange 38 which is air tightly fixed to skirt 32 below the reduced portion 34. The burner top pan 36 is provided with a central opening 40 which is covered by a burner screen 42. A combustion chamber 44 is defined by tank bottom wall 24, the top portions of skirt 32 and burner top pan 36. The combustion chamber 44 is air tight other than through the screen 42 and the flue 26.

A disc-shaped burner bottom pan 52 is provided at the bottom of skirt 32. Burner bottom pan 52 is either provided with a flange (not shown) allowing attachment to the skirt 32 or is formed integrally with skirt 32. In either embodiment, burner bottom pan 52 is joined to skirt 32 in an air tight manner. Skirt 32 is pierced on one side by an air and fuel proportioner 54. Air and fuel proportioner 54 is comprised of a tube 56 mounted in a circular opening 58. Tube 56 is open at its inboard end 60. Tube 56 is provided with a conical enlarging portion 62 near its outboard end 64. The outboard end 64 is also provided with a drape portion 66 that connects between the upper and lower portions of outboard end 64. As can be best seen in FIG. 2, drape portion 66 anchors gas line 78 and maintains nozzle 82 in position.

A thermostat 72 senses the temperature of the body of water contained in tank 12 by means of a sensor 74. Thermostat 72 receives gas through a supply line 76 and provides gas through a gas line 78 to air and fuel proportioner 54. Thermostat 72 also controls the operation of igniter 80 located in combustion chamber 44. When thermostat 72 senses low water temperature, it provides gas to air and fuel proportioner 54 through nozzle 82. Gas and air are drawn through tube 56 into burner chamber 86 defined by the lower portion of skirt 32, burner top pan 36 and burner bottom pan 52. The air and fuel mixture flows through screen 42 and is combusted at the top surface 90 of the screen 42.

Figure 3:
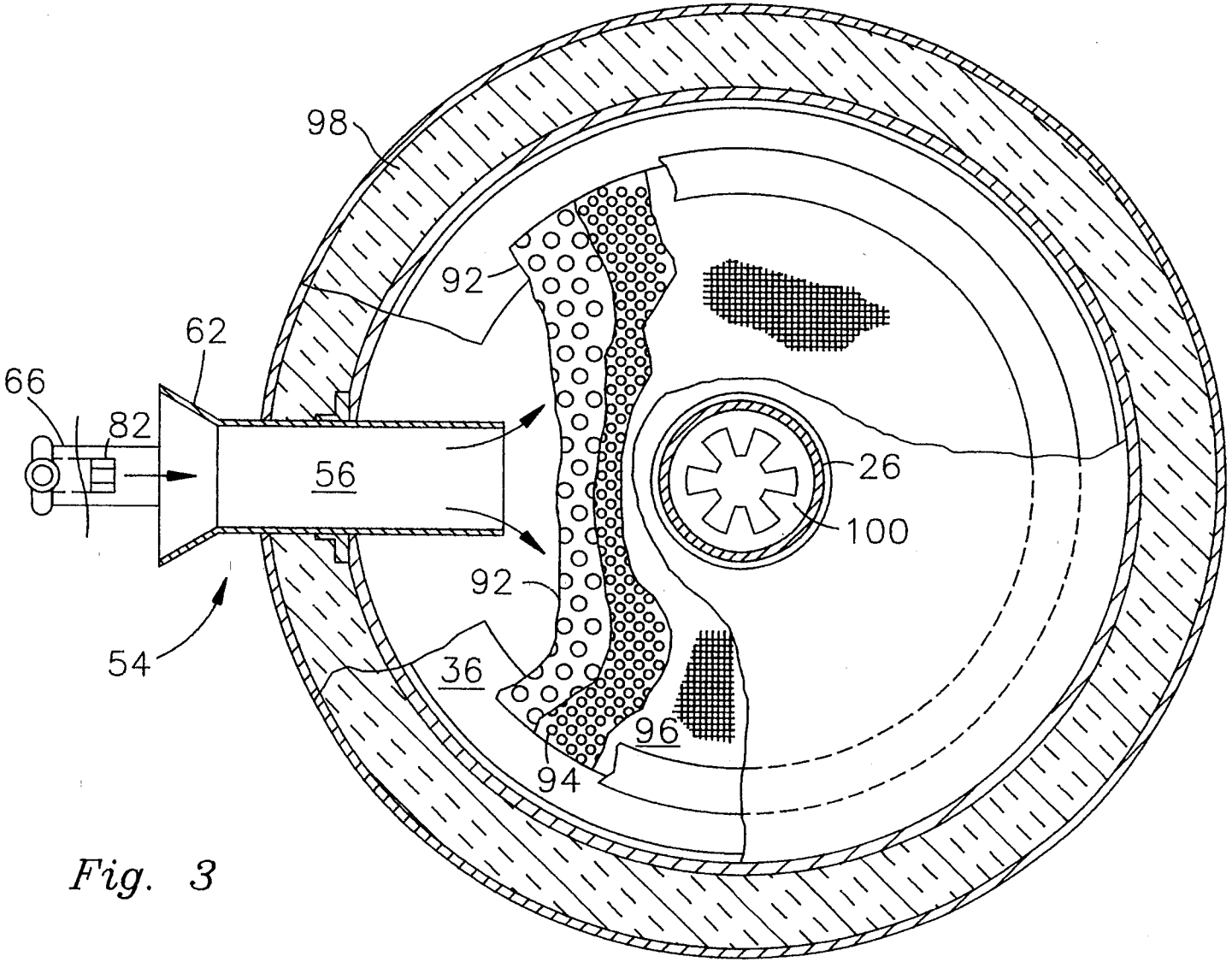
FIG. 3 is a downward looking cross-sectional view taken along line 3—3 of FIG. 2 and showing details of the burner screen construction.

Screen 42 (see FIGS. 2 and 3) comprises a perforated metal lower layer 92, a perforated metal intermediate layer 94 and a woven wire top layer 96. Lower layer 92 is provided with a plurality of 0.25 inch (0.65 centimeter) diameter circular holes on 0.375 inch (1 centimeter) centers in a staggered pattern. This results in approximately 40% of the surface area of lower layer 92 being open. Intermediate layer 94 is provided with 0.093 inch (0.24 centimeter) diameter holes on 0.156 inch (0.4 centimeter) centers in a staggered pattern resulting in the surface of intermediate layer 94 being 33% open space. Woven wire top layer 96 is woven from Inconel type 601 wire of 0.014 inch (0.036 centimeter) diameter in a 30×32 mesh weave. This results in approximately 32% of the surface area of woven top layer 96 being open.

The interaction of screen lower layer 92 and screen intermediate layer 94 results in an even distribution of fuel and air through woven wire top 96. The fuel and air flows through top layer 96 and is consumed, producing heat along screen top surface 90. Heat radiates from this combustion zone in a pattern following the surface contour of screen top surface 90. As shown in FIG. 2, screen top surface 90 is dome-shaped and concave upwardly. Screen top surface 90 provides a pattern of radiation directing the heat of combustion at tank bottom wall 24 and not at skirt 32. This results in two significant advantages. First, maximum usable heat is directed to the tank containing the water to be heated. Second, the temperature of skirt 32 surrounding combustion chamber 44 is kept low. Special insulation techniques involving use of high temperature insulation material are therefore not required. Thus, the body of insulation 98 surrounding water tank 12 and the combustion chamber 44 can be a single body of foamed in place insulation. In many typical prior art water heaters, foamed in place insulation 98 is used around the tank 12 and a separate body of insulation, such as fiberglass or special heat resistant foam, is used around combustion chamber 44.

Figure 4:
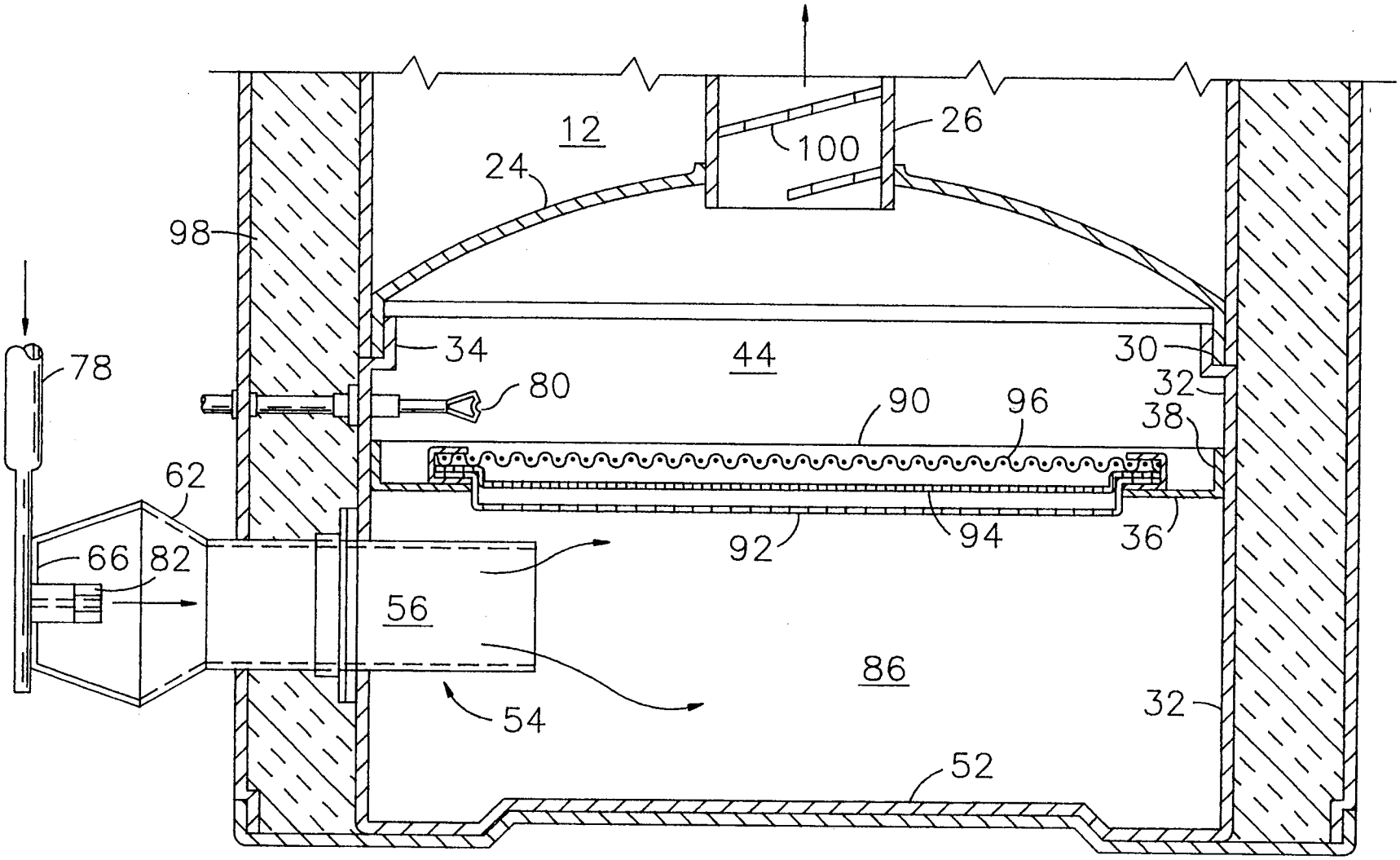
FIG. 4 is an enlarged detail drawing of the combustion chamber burner area similar to FIG. 2 showing an alternate burner screen.

An alternate screen design is shown in FIG. 4. The alternate construction shown in FIG. 4 is the same as that seen in FIG. 2 except that lower layer 92, intermediate layer 94, and woven wire top layer 96 are flat rather than domed. The pattern of heat radiation formed at the screen top surface originates from a planar surface and is directed uniformly vertically upward. This results in a concentration of heat slightly removed from the outside periphery of the bottom of tank 12. Heat is kept away from skirt 32 even at the top portion of the skirt.

Figure 5:
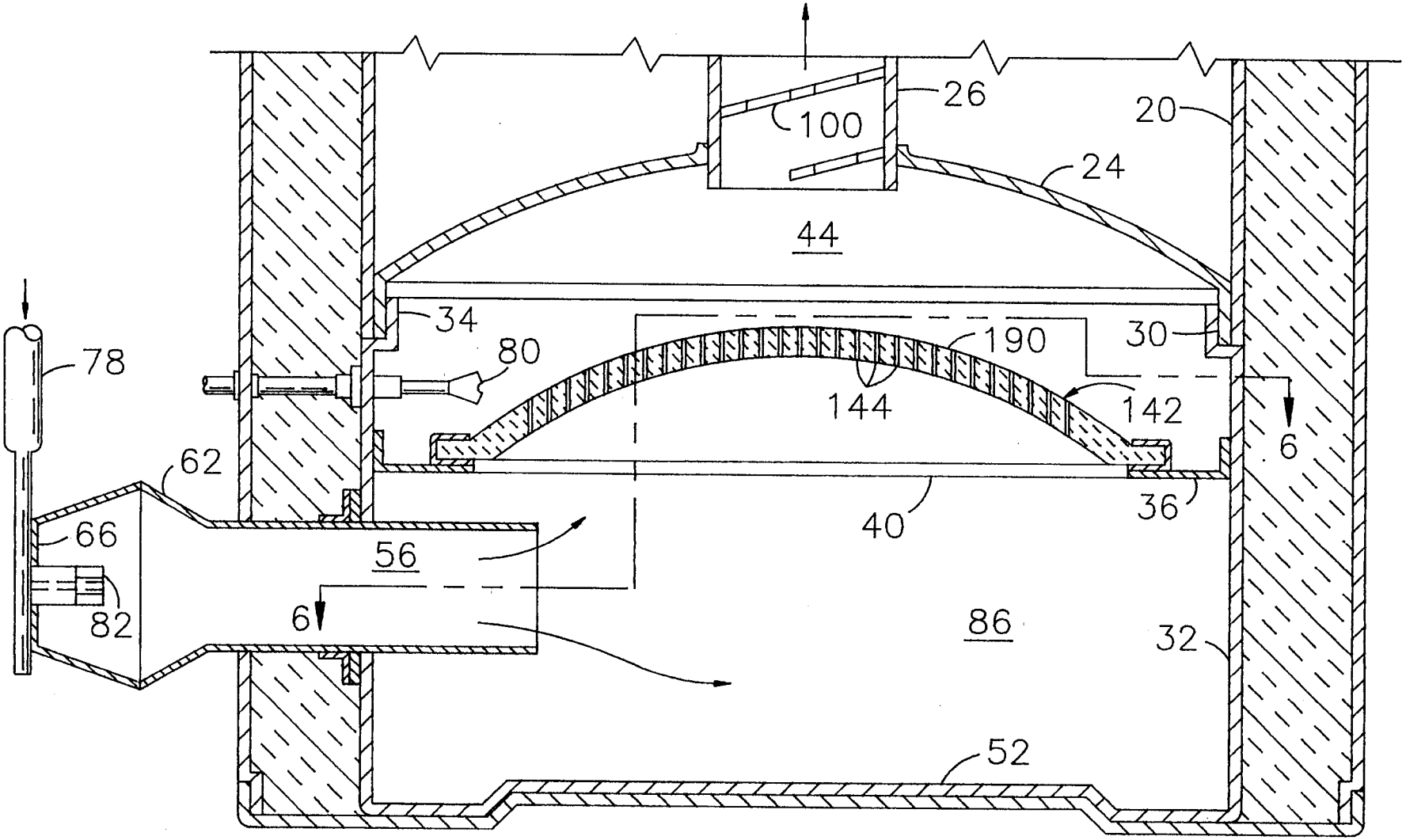
FIG. 5 is a view similar to FIGS. 2–4 showing another alternate burner screen.
Figure 6:
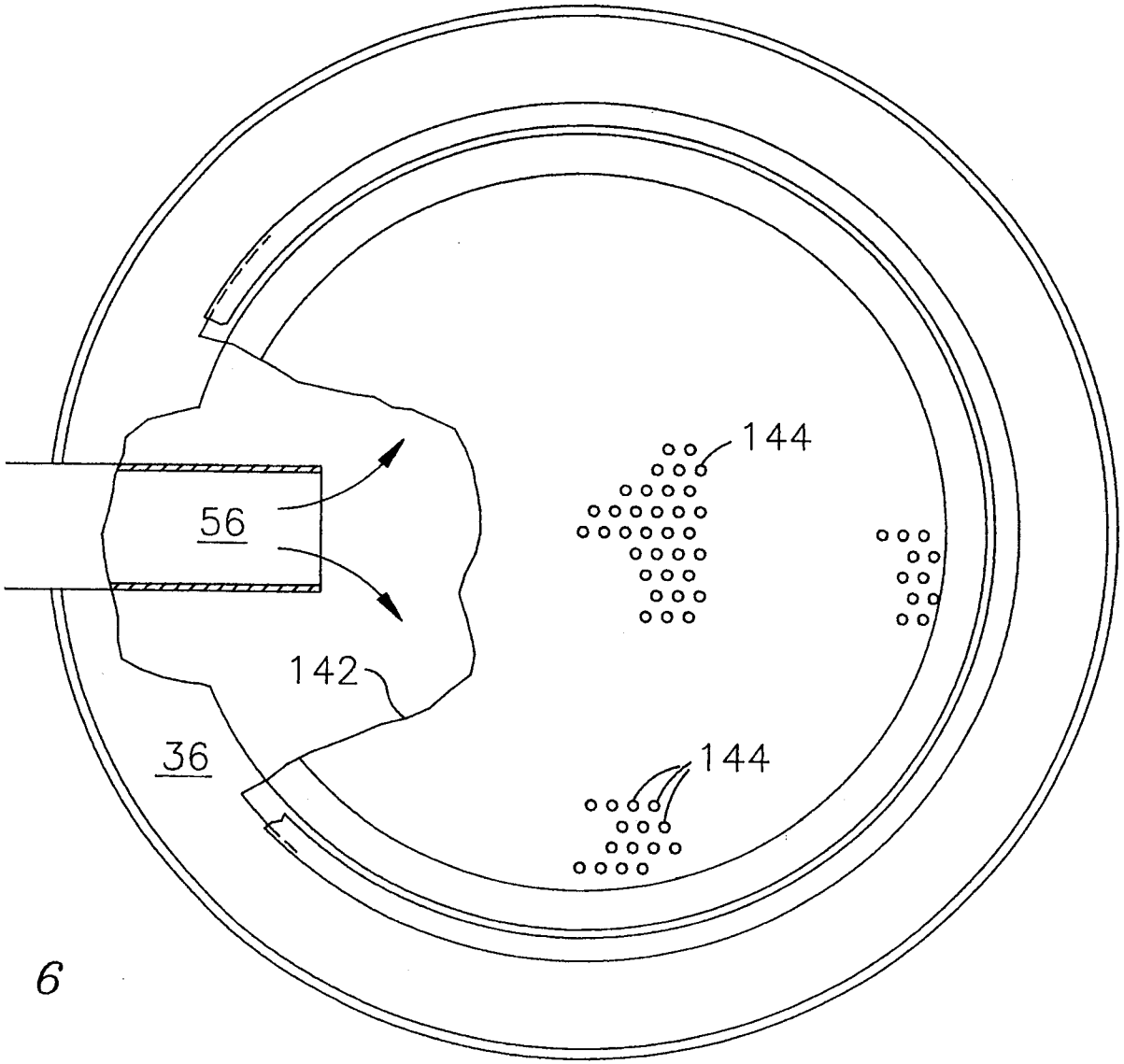
FIG. 6 is a downwardly looking plan view taken along line 6—6 of FIG. 5 showing, schematically, details of the screen of FIG. 5.

A second alternate screen design is shown in FIGS. 5 and 6. Alternate screen 142 is a one-piece, fiber matrix construction resembling ceramic. Screen 142 is nonmetallic and approximately one-half inch thick. It is domed and similar in shape to screen 42 as seen in FIG. 2.

Rather than three separate layers, a single structure comprised of a fiber matrix having a multiplicity of regularly arrayed ports 144 having a diameter of about 0.076 inches (0.193 centimeter) is provided. The ports account for approximately one-third the surface area of the fiber matrix screen. Screen 142 is ported over its entire area except for a peripheral area used for attachment to top pan 36. The fiber matrix screen provides the fuel and air distribution functions of the two lower levels of the screen seen in FIG. 2 and also defines top surface 190 of the screen upon which combustion occurs in a manner similar to woven wire top layer 96 in FIG. 2. The one-piece design of fiber matrix screen 142 simplifies construction although multiple piece constructions are contemplated.

Figure 7:
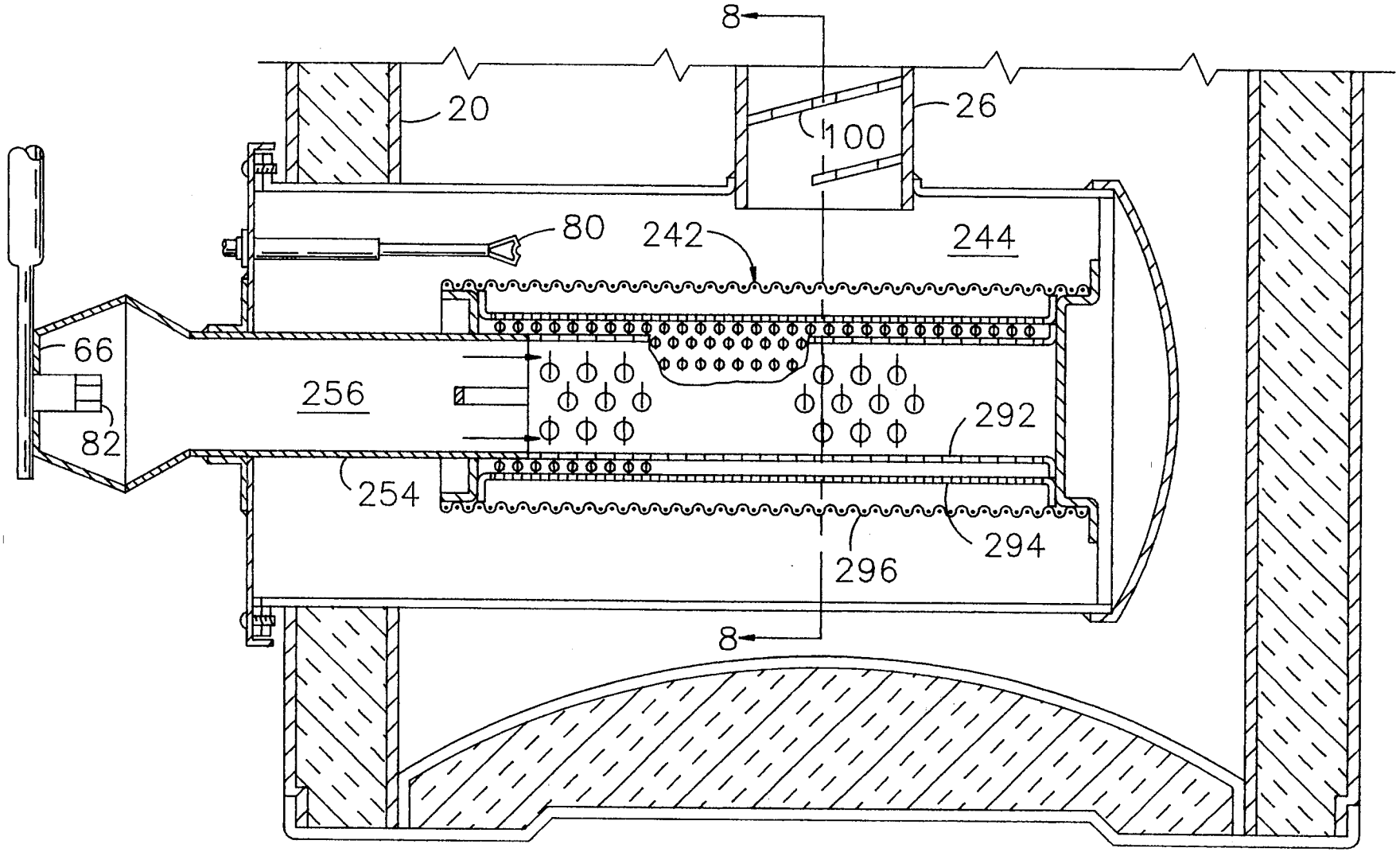
FIG. 7 is a cross-section of the combustion chamber burner area of a submerged combustion chamber type water heater using aspects of the invention.
Figure 8:
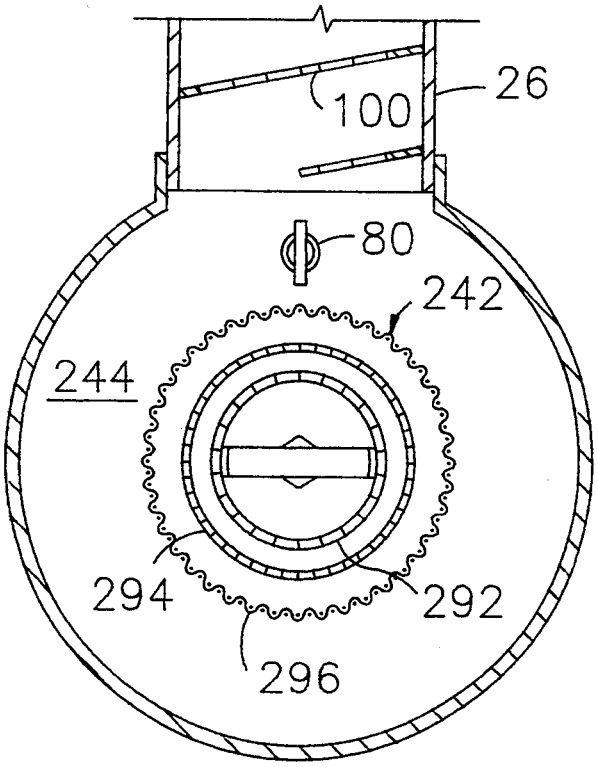
FIG. 8 is a cross-sectional view taken along line 8—8 of FIG. 7.

FIGS. 7 and 8 show still another alternate screen design. The screen design shown in FIGS. 7 and 8 is essentially a cylindrical design suitable for use in a submerged chamber type water heater. The submerged chamber is designated by the number 244 and is substantially surrounded by water within the water tank in the usual manner. Screen 242 includes a perforated metal inner layer 292, a perforated metal intermediate layer 294 and a woven wire top layer 296. These layers, 292, 294 and 296, are similar to and perform the same functions as perforated metal lower layer 92, perforated metal intermediate layer 94 and woven wire top layer 96 of screen 42 shown in FIGS. 2 and 3. The materials of construction and degree of perforation are preferably the same as in screen 42 of FIGS. 2 and 3. Layers 292, 294 and 296 are concentrically positioned with respect to one another and connect to tube 256 of fuel and air proportioner 254. In operation, air enters fuel and air proportioner 254 in the same manner as previously described with respect to fuel and air proportioner 54 of FIGS. 2 and 3 and mixes with fuel supplied through nozzle 82. The fuel and air mixture travels through tube 256 and interiorly of screen 242, inwardly of perforated metal inner layer 292. The fuel and air mixture proceeds through inner layer 92, through intermediate layer 94 and outwardly of wire top layer 296, wherein combustion occurs within submerged chamber 244. Heat radiates radially outwardly from screen 242 against submerged chamber 244 to heat water within the tank.

As can be seen in FIG. 1, the operation of water heater 10, which is apparent to the end user, seems to be the same as the operation of the conventional water heater. When hot water is required, the thermostat provides gas to air and fuel proportioner 54 which is burnt within combustion chamber 44 and heat extracted in combustion chamber 44 and flue 26. When the water in tank 12 is heated, thermostat 72 interrupts the flow of gas to nozzle 82 and combustion ceases. Because hot water is contained within the tank, a draft through the water heater is maintained and the air and fuel mixture contained within burner chamber 86 is drawn up through screen 42 to be combusted prior to the extinguishing of combustion on the top surface of screen 90.

However, operation of a water heater in accordance with the invention has several significant advantages. Efficiency is improved. Heat is primarily directed only to the water containing tank and is not directed to skirt 32 where it would be wasted. Foam of the type used as insulation for tank 12 can be used around the combustion chamber resulting in better insulation and better efficiency. Screen 42, and particularly top layer 96, acts as a flame arrester preventing the migration of combustion into burner chamber 86. Drape 66 and air and fuel proportioner 54 minimize the likelihood of the escape of minor amounts of gas when combustion is initiated or terminated. The initial or terminal portion of gas dispensed from nozzle 82 will be contained within drape portion 66 to be drawn into the water heater by the draft of water heater 10 even when the water heater is not in operation.

Importantly, a water heater constructed in accordance with the present invention is less expensive to manufacture than a conventional water heater. No burner separate from the combustion chamber need be constructed. No radiant heat reflector sheet needs to be positioned below the burner as the burner itself acts to localize radiation of heat upwardly towards the bottom of the water containing tank. Standby losses are also minimized in the current design as only primary air is being used. Primary air is that drawn through the burner for use directly in the combustion process as opposed to secondary air which is drawn around the burner and used to cool the burner as well as sometimes in the combustion process.

The invention has been described with reference to preferred embodiments. Modifications and alterations will occur to others upon the reading and understanding of this specification and it is my intention to include such modifications and alterations insofar as they come within the scope of the appended claims.

Having thus described the invention, it is claimed:

1. A water heater comprising:

a tank adapted to contain a body of water, said tank having a water inlet, a water outlet and a bottom;

a combustion chamber defined by said tank bottom, a side wall substantially gas tightly sealed to said tank bottom and a bottom pan substantially gas tightly sealed to said side wall;

a flue passing through said tank having an inlet in said tank bottom:

a burner substantially gas tightly sealed along and to said side wall and adapted to contain combustion above said burner;

a fuel and air proportioner adapted to admit air and fuel to said combustion chamber;

said combustion chamber being substantially gas tight except for said proportioner and said flue.

2. The water heater of claim 1, wherein said burner comprises a fine wire mesh screen top layer and at least one perforated metal lower layer.

3. The water heater of claim 1, wherein said burner comprises a fine wire mesh screen top layer, a perforated metal intermediate layer and a perforated metal lower layer.

4. The water heater of claim 1, wherein said burner is comprised of wire having a diameter of about 0.014 inches (0.036 cm).

5. The water heater of claim 1, wherein said burner is about 30% open.

6. The water heater of claim 1, wherein said burner is fabricated from Inconel.

7. The water heater of claim 1, wherein said tank bottom is generally concave with respect to said combustion chamber.

8. The water heater of claim 1, wherein said burner is a cast fiber matrix.

9. The water heater of claim 8, wherein said burner has a port area having a multiplicity of ports having a diameter of about 0.076 of an inch (0.193 of a centimeter) and said ports account for about one-third of the surface area of said ported area.

10. The water heater of claim 1, wherein said burner is about one-half inch (one and one quarter centimeters) thick.

11. The water heater of claim 9, wherein said ports have a diameter of about 0.076 inches (0.193 cm) and said ports account for about thirty-three percent of the surface area of said ported area.

12. The water heater of claim 3, wherein said burner intermediate layer comprises a sheet having perforations of about one-tenth inch (one quarter centimeter) diameter arrayed thereon and occupying about one-third the area of said layer; and said screen lower layer comprises a sheet having perforations of about one-quarter inch (two-thirds centimeter) diameter arrayed thereon and occupying about four-tenths the area of said layer.

13. The water heater of claim 12, wherein said intermediate layer perforations are about 0.093 inches (0.236 centimeters) in diameter.

14. The water heater of claim 1, wherein said fuel and air proportioner comprises a venturi tube penetrating said side wall, said venturi tube comprising an inner open end within said combustion chamber and an outer open end outside said combustion chamber.

15. The water heater of claim 1, wherein said burner is generally convex with respect to said bottom pan.

16. The water heater of claim 1, wherein said burner is ceramic fiber matrix.

17. The water heater of claim 16, wherein said burner has a multiplicity of regularly arrayed ports extending therethrough.

18. The water heater of claim 17, wherein said ports have a diameter of about 0.076 inches (0.193 cm).

19. The water heater of claim 17, wherein said openings of said ports comprise about one-third the surface area of said burner.

20. The water heater of claim 1, wherein said fuel and air proportioner extends through said side wall.

21. A water heater comprising:

a tank adapted to contain a body of water, said tank having a water inlet, a water outlet and a bottom;

a flue passing through said tank having an inlet in said tank bottom;

a skirt substantially gas tightly fixed to said tank bottom;

a burner top pan having a burner opening substantially gas tightly fixed along and to said skirt whereby a combustion chamber is defined within said skirt between said tank bottom and said burner top pan;

a burner fixed to said burner top pan along said burner opening;

a burner bottom pan substantially gas tightly fixed along and to said skirt whereby a burner chamber is defined within said skirt between said burner top pan, said burner and said burner bottom pan; and a fuel and air proportioner adapted to admit fuel and air into said burner chamber.

22. A water heater comprising:

a tank adapted to contain a body of water having a water inlet and a water outlet;

a sealed heating chamber adjacent said tank adapted to contain burner apparatus and combustion of fuel and air and produce heat products of combustion;

a flue communicating with said heating chamber and passing through said tank;

a burner having a substantially cylindrically shaped side wall positioned within said heating chamber and adapted to permit air and fuel to pass outwardly of said side wall and to combust exteriorly of said side wall; and an air and fuel proportioner extending inwardly through a side portion of said heating chamber and adapted to admit air and fuel to said burner.

* * * * *